United States Patent [19]

Kienhöfer

[11] Patent Number: 4,464,917

[45] Date of Patent: Aug. 14, 1984

[54] SWAGING MACHINE

[75] Inventor: Klaus Kienhöfer, Niefern-Öschelbronn, Fed. Rep. of Germany

[73] Assignee: Gebr. Felss, Konigsbach-Stein, Fed. Rep. of Germany

[21] Appl. No.: 465,443

[22] Filed: Feb. 10, 1983

[30] Foreign Application Priority Data

Feb. 17, 1982 [DE] Fed. Rep. of Germany ..... 3205584

[51] Int. Cl.[3] ..... B21J 7/16

[52] U.S. Cl. ..... 72/76; 72/402

[58] Field of Search ..... 72/76, 402

[56] References Cited

U.S. PATENT DOCUMENTS 2,433,152 12/1947 Patnaude ..... 72/76

2,485,326 10/1949 Smith ..... 72/76

FOREIGN PATENT DOCUMENTS 94746 7/1980 Japan ..... 72/76

*Primary Examiner*—Lowell A. Larson

*Attorney, Agent, or Firm*—Balogh, Osann, Kramer, Dvorak, Genova & Traub

[57] ABSTRACT

This invention relates to a swaging machine comprising depth-setting wedges for the use of the machine for recess swaging. These wedges are disposed between each die and the ram for actuating the die and are displaceable parallel to the axis of the machine by means of depth-setting flange, on which said wedges are detachably mounted. The wedges are adapted to be axially inserted into the depth-setting flange so that the large end portion of each wedge is held on said flange, and spring-loaded detent pins are preferably mounted on said flange and adapted to retain said large end portions of said wedges by snapping into detent recesses provided on said large end portions on opposite sides thereof.

13 Claims, 4 Drawing Figures

SWAGING MACHINE

This invention relates to a swaging machine comprising depth-setting wedges for the use of the machine for recess swaging. These wedges are disposed between each die and the ram for actuating the die and are displaceable parallel to the axis of the machine by means of depth-setting flange, on which said wedges are detachably mounted.

Known swaging machines comprise radially guided dies, which are oscillated to reduce the cross-section of rod or tube stock as the latter is fed.

It is also known that for recess swaging the oscillation of the dies can be superimposed by a radial depth-setting movement of the dies toward the stock. For this purpose, depth-setting wedges are inserted between the die-actuating rams and the dies in a direction which is parallel to the axis of the machine. These wedges are displaced by means of a displaceable depth-setting flange, in which said wedges are movably hung so that they can follow the oscillation of the dies and, if desired, can impart to the dies the depth-setting movement toward the stock.

When the swaging machine is to be prepared for swaging different workpieces, the dies, which can be removed in a simple manner, must be replaced and in cases the wedges must be replaced too to permit a cleaning of the die-actuating mechanism or because the wedges having a different taper. This removal and replacement of the wedges in the known machine is a difficult operation. For instance, the die-actuating rams must be removed for a removal of wedges which are movably hung in the flange. Besides, additional space for the insertion and removal of the wedges is required in the radial direction in the known machines.

It is a main object of the invention to provide for swaging machines having depth-setting wedges for recess swaging a wedge mechanism which is compact and can easily be replaced.

It is another object of the invention to provide such a machine in which the wedges can easily be removed and in which dies having wedge faces can easily be replaced by dies having no wedge faces so that the machine can easily be altered for an operation without depth-setting wedges.

In a swaging machine comprising depth-setting wedges for use for adjusting the dies for the swaging of recesses, which wedges are disposed between the die-actuating rams and the dies and are detachably mounted on depth-setting flange, which is operable to displace said wedges parallel to the axis of the machine, these and other objects are accomplished according to the invention in that the wedges are adapted to be axially inserted into the depth-setting flange so that the large end portion of each wedge is held on said flange, and spring-loaded detent pins are preferably mounted on said flange and adapted to retain said large end portions of said wedges by snapping into detent recesses provided in said large end portions on opposite sides thereof. For this purpose the wedges are provided on both sides of their large end portions with generally radial grooves, which receive the detent pins, which extend in a common transverse plane, as the wedges are inserted parallel to the axis of the machine through openings in the flange, so that the wedges are held in said flange for a lost motion.

Further details of the swaging machine embodying the invention and comprising depth-setting wedges are apparent from the drawing, which shows preferred embodiments of the invention.

Figure 1:
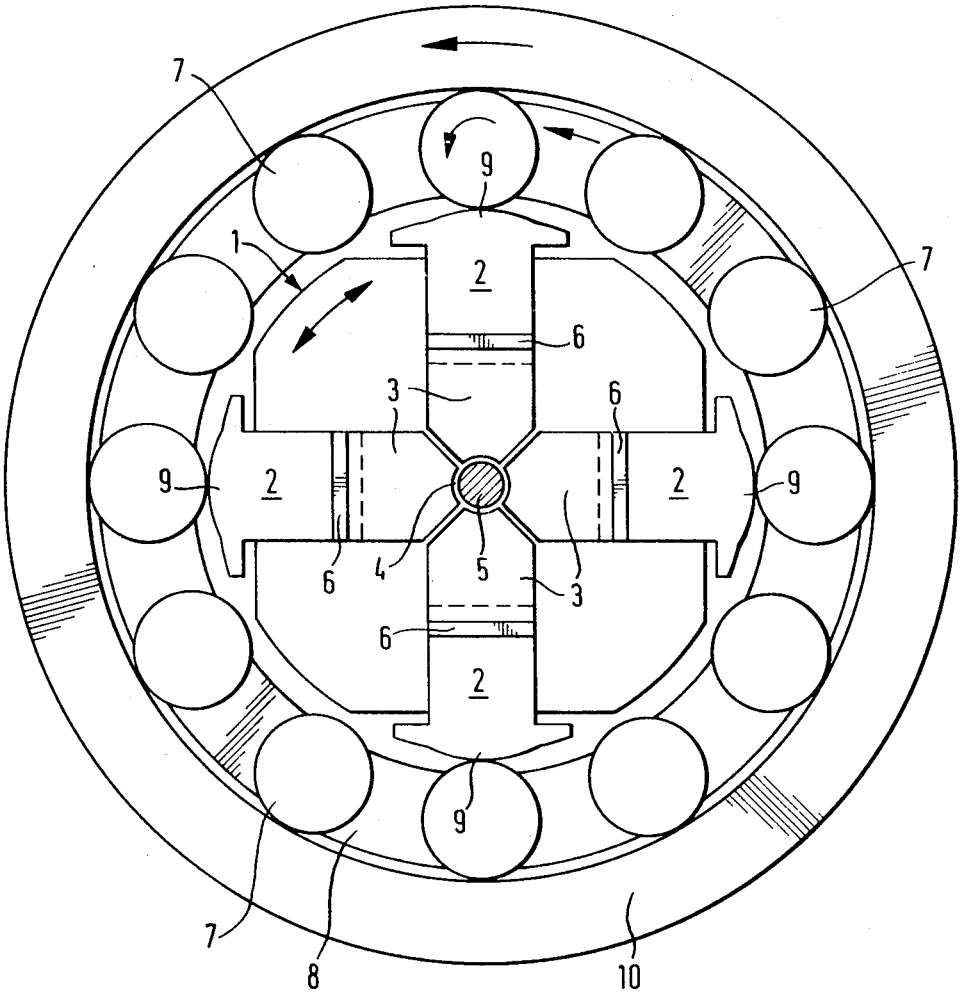
FIG. 1 is a front elevation showing a swaging mechanism.

As is apparent from the drawing the swaging mechanism comprises a die-actuating shaft 1 provided with die-actuating rams 2 and dies 3, which define an opening 4 through which the workpiece or stock 5 which is to be swaged is advanced. Depth-setting wedges 6 are disposed between the dies 3 and the rams 2 and are displaceable parallel to the axis of the machine. The rams 2 are surrounded by a circular series of pressure-applying rollers 7, which are disposed in a cage 8 and revolve in an outer race 10 and during a rotation of the shaft 1 act on the heads 9 of the rams 2. In different embodiments, the outer race 10 rather than the shaft 1 might be rotated or the shaft 1 and the outer race 10 might rotate in the same sense at different speeds or in opposite senses. The relative rotational movement of the shaft 1 and the outer race 10 results in an oscillating motion of the rams 2 and of the dies 3. By means of the depth-setting wedges 6, a radial depth-setting movement can be super-imposed on said oscillating motion of the dies. Such swaging machines are known to comprise two, three or four dies.

To permit a removal and replacement of the depth-setting wedges 6, they extend in the axial direction through recesses or openings 13 of the depth-setting flange 12 so that the large end portions 11 of the wedges 6 are retained in the flange 12. For this purpose the flange 12 is provided with spring-loaded detent pins 14, which are adapted to snap into detent recesses 15 disposed laterally of the large end portions 11 of the wedges. The detent recesses 15 consist of grooves 15, which are disposed on opposite sides of the large end portion 11 of each wedge and extend parallel to the central radial plane of the respective wedge. The motion of the detent pins 14 is limited so that clearances are left between the pins 14 and the grooves 15 when the pins 14 have snapped into the grooves 15. In this way, each wedge 6 has relative to the flange 12 the lost motion which is required because the wedges 6 extending between the rams 2 and the dies 3 must follow the motion of said parts 2, 3.

Figure 3:
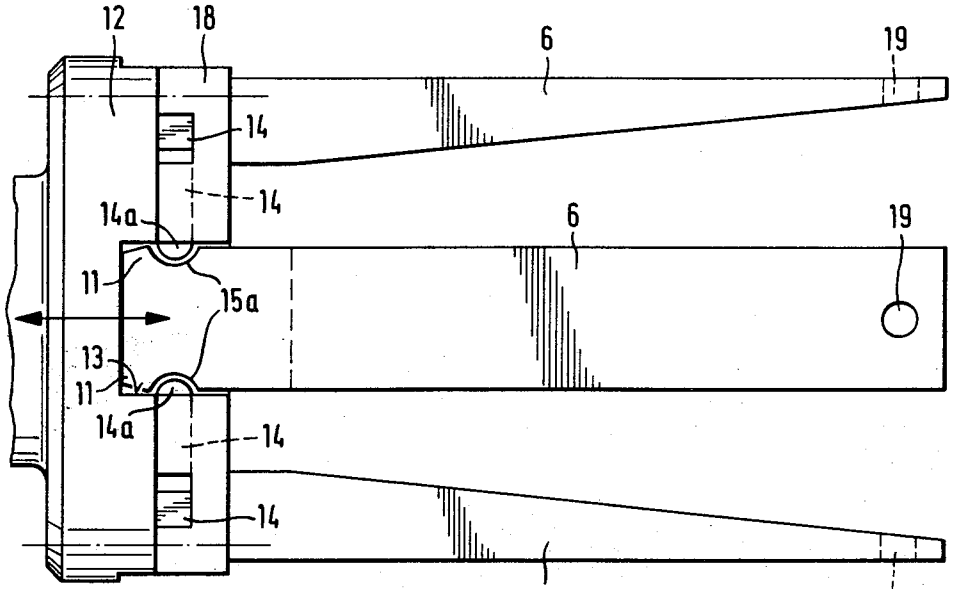
FIG. 3 is a side elevation showing the wedges and their connection to the depth-setting flange.
Figure 4:
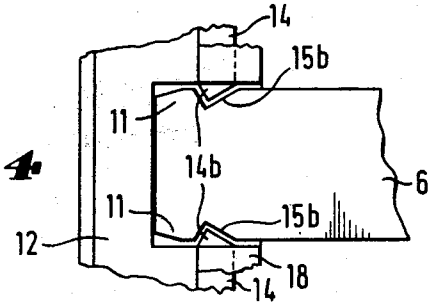
FIG. 4 shows detent means differing from those shown in FIG. 3.
Figure 2:
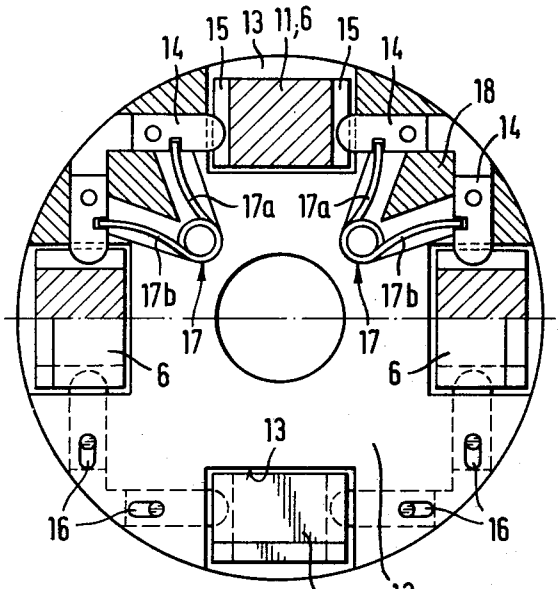
FIG. 2 is a transverse sectional view taken on a plane in front of the depth-setting flange and showing the machine partly cut open.

It is apparent from FIG. 2 that the detent pins 14 are slidably mounted in the flange 12 on opposite sides of one respective openings 13 which receive the large end portions 11 of the wedges. In the flange 12, the detent pins extend along a secant and are capable of a lost motion along said secant. As is apparent from FIG. 3, the detent recesses 15 may consist of grooves having the shape of an arc of a circle in cross-section and in that case the detent pins 14 may have a hemispherical inner end portiion **14*a* and a square-section shank. As is shown in FIG. 4, the detent recesses formed in the large end portions 11 may consist of grooves 15*b*, which are L-shaped in cross-section, and in that case the inner end portion 14*b* of the detent pins may be angled and that side of said end face which faces toward the small end portion of the wedge is less steep than that side which faces in the opposite direction. The motion of the detent pins 14 may be limited by the cooperation of a crosspin and a slot 16** or by a stop shoulder which is not shown.

Each of the detent pins 14 is biased by a helical torsion spring 17, which has extended end legs 17*a*, 17*b* and tends to move the detent pin 14 into the associated groove 15. In swaging machines comprising three or four dies, each of said springs is associated with two adjacent ones of said detent pins 14, which are associated with adjacent wedges 6 and extend at an angle to each other. In that case, each of the legs 17*a*, l7*b* of said spring engages one of the detent pins 14 with which said spring is associated. This will result in a space-saving arrangement as is shown in FIG. 2. The detent pins 14 and the springs 17 are mounted on a mounting plate 18, which is screw-connected to the flange 12, as is shown in FIG. 3. At its small end remote from the shoulder 11, each wedge 6 is formed with a hole 19 and can be unlocked in that a rod is inserted into the hole 19 when the wedge has been fully extended and is used to push back the wedge. To interlock each wedge 6 with the flange 12, the wedge 6 may be pushed forward by hand.

What is claimed is:

1. In a swaging machine which defines a path for a workpiece to be swaged and comprises a plurality of dies, which are spaced around and radially movable with respect to said path, a plurality of rams, which are spaced around said path radially outwardly of and radially aligned with respective ones of said dies and radially movable with respect to said path, die-actuating means operable to oscillate said dies radially with respect to said path with the aid of said rams, a plurality of depth-setting wedges, which are spaced around and extend along said path, each of said wedges having a small end portion and a large end portion and being movable along said path to insert said small end portion between one of said dies and the die-actuating ram which is radially aligned with said die and thus to control the extent to which said die is movable toward said path by said die-actuating means and to permit the use of the machine for recess swaging, and a depth-setting flange, which extends across and is movable along said path and to which all said wedges are detachably connected, the improvement residing in that said flange has a plurality of through openings, which are spaced around said path and accommodate said large end portions of respective ones of said wedges, and detent means are provided, by which said large end portions of said wedges are releasably held in said flange in said openings.

2. The improvement set forth in claim 1, wherein said detent means comprise detent recesses provided in each of said wedges on opposite sides of said large end portion, detent pins slidably mounted on said flange and removably extending into said detent recesses and spring means urging said detent pins into said recesses.

3. The improvement set forth in claim 2, wherein said detent recesses consist of grooves formed in said large end portions of said wedges and extending parallel to the central radial plane of the associated wedge, all said detent pins extend generally in the same plane, and stop means are provided which limit the movement of said detent pins into said grooves so as to leave clearances between said detent pins and grooves and permit a lost motion between said wedges and said flange.

4. The improvement set forth in claim 3, wherein each of said grooves is defined by an arc of a circle in cross-section and each of said detent pins has a hemispherical inner end portion conforming to one of said grooves and has a square section shank.

5. The improvement set forth in claim 3, wherein each of said grooves is L-shaped in cross-section and each of said detent pins has an inner end portion angled inner end face conforming to one of said grooves and has a square-section shank.

6. The improvement set forth in claim 5, wherein each of said angled end faces has a first surface facing toward said small end of said wedge and a second surface facing away from said small end of said wedge and said first surface has a smaller angle of inclination to the longitudinal direction of said detent pin than said second surface.

7. The improvement set forth in claim 2, wherein two of said detent pins are mounted on said flange on opposite sides of each of said openings and extend along a secant with respect to said path and are movable along said decant into and out of said detent recesses of the wedge extending through said opening, said flange is provided with guide means for guiding said detent pins along said secant, and stop means are provided, which limit the motion of each of said detent pins along said secant into said recesses so as to leave clearances between said detent pins and said recesses.

8. The improvement set forth in claim 7, wherein said stop means comprise a slot extending along each of said detent pins and a cross-pin extending through said slot.

9. The improvement set forth in claim 7, wherein said stop means comprise a stop shoulder provided on each of said detent pins.

10. The immprovement set forth in claim 2, wherein said spring means comprise helical springs having extended end portions, which extend laterally into said detent pins and urge them toward the associated detent recesses.

11. The improvement set forth in claim 10 as applied to a swaging machine comprising at least three of said dies, wherein each of said spring is disposed between two of said openings and said extended end portions of each of said springs extend laterally into adjacent ones of said detent pins associated with adjacent ones of said openings.

12. The improvement set forth in claim 2, wherein said detent pins and said spring means are carried by a mounting plate, which is secured by screws to said flange.

13. The improvement set forth in claim 1, wherein said small end portion of each of said wedges extends beyond the associated die and the associated ram and is formed with a transverse through hole, which is engageable by an implement for pushing back said wedge so as to release said large end portion thereof from said flange.

* * * * *